United States Patent [19]

Goodlander

[11] Patent Number: 4,626,048

[45] Date of Patent: Dec. 2, 1986

[54] COMPUTER PRINTER HOUSING

[75] Inventor: Theodore J. Goodlander, Nashua, N.H.

[73] Assignee: Cab-Tek, Inc., Nashua, N.H.

[21] Appl. No.: 788,387

[22] Filed: Oct. 17, 1985

[51] Int. Cl.[4] ..... A47B 21/00

[52] U.S. Cl. ..... 312/208; 312/236; 312/283; 312/330 R; 312/214; 400/613.2; 400/691

[58] Field of Search ..... 52/36; 181/201; 400/613.2, 691; 108/60; 312/208, 236, 283, 330 R, 214, 286, 245

[56] References Cited

U.S. PATENT DOCUMENTS

| | | | |
|---|---|---|---|
| 3,365,259 | 1/1968 | Heisman et al. | 312/286 X |
| 4,215,762 | 8/1980 | Cunningham et al. | 181/201 |
| 4,345,803 | 8/1982 | Heck | 312/196 X |
| 4,365,855 | 12/1982 | Mark | 312/245 X |

*Primary Examiner*—Carl D. Friedman
*Attorney, Agent, or Firm*—Hayes, Davis & Soloway

[57] ABSTRACT

A supporting and sound-proofing housing for use with computer output printers and the like particularly adapted for mounting in a modular wall system to provide access thereto from either side. The housing comprises a box having a pair of vertical spaced side walls, a top member interconnecting the tops of the side walls and a bottom member interconnecting the bottoms of the side walls to form an enclosure having opposed openings thereto on opposite sides thereof. Doors are provided for opening and closing respective ones of the openings. The side walls include means for releasably attaching a modular wall partition thereto so that the housing can be built into a partitioning wall. A slidable shelf adapted to support a printer or the like is mounted between the side walls for slidable movement between the openings to provide working access to the printer or the like from either of the openings, i.e. from either office. The enclosure is lined with a sound-deadening material and the top member includes cooling means for drawing cooling air through the enclosure and exhausting it along a noise-suppressing path.

11 Claims, 9 Drawing Figures

COMPUTER PRINTER HOUSING

BACKGROUND OF THE INVENTION

The present invention relates to accessories for use with computer systems and, more particularly, to a supporting and sound-proofing housing for use with computer output printers and the like comprising a box having a pair of vertical spaced side walls, a top member interconnecting the tops of the side walls and a bottom member interconnecting the bottoms of the side walls to form an enclosure having opposed openings thereto on opposite sides thereof; first and second door means disposed for openably closing respective ones of the openings; means included within the side walls for releasably attaching a modular wall partition thereto; a slidable shelf adapted to support a printer or the like mounted between the side walls for slidable movement between the openings to provide working access to the printer or the like from either of the openings; and, a sound-deadening material disposed on the side walls and top member within the chamber.

In a common office environment, it is common practice to have a number of computer terminals or workstations attached to a single output device such as a dot matrix printer, or the like. While this does provide high productivity from the single printer, it also causes high noise levels and the need to provide a way of handling large quantities of paper. A typical prior art approach to the problem is shown in FIG. 1. The printer 10 is supported by the tabletop 12 of stand 14. A sound-proofing cover 16 is disposed over the printer 10. Cover 16 is provided with a raisable door 18, a muffin fan 20 (to provide cooling airflow therethrough), and a slot at 22 through which the paper 24 can exit. A shelf 26 is provided to catch the paper 24. In some embodiments, a wire basket is provided in lieu of the shelf 26. Typically, the cover 16, or at least the door 18, is made of clear plastic so that operation of the printer 10 can be observed with the door 18 in its lowered position.

The prior art approach of FIG. 1 is not very compatible with the modern trend in offices which is towards individualized spaces or offices defined by movable and replaceable modular wall units. The printer stand 14 of FIG. 1 is typically placed in its own area and users must go to that area to retrieve printed materials. If the printer stand 14 were to be placed between two offices defined by modular wall units, a space in the walls would have to be provided for the stand 14 with the result that the separation between the offices would be destroyed.

Wherefore, it is the object of the present invention to provide a computer printer housing particularly adapted for use with modular wall systems providing ease of access from either one of two adjacent offices.

SUMMARY PARAGRAPH

The foregoing objectives have been accomplished by the supporting and sound-proofing housing of the present invention comprising a box having a pair of vertical spaced side walls, a top member interconnecting the tops of the side walls and a bottom member interconnecting the bottoms of the side walls to form an enclosure having opposed openings thereto on opposite sides thereof; first and second door means disposed for openably closing respective ones of the openings; means included in the side walls for releasably attaching a modular wall partition thereto whereby the housing can be built into a partitioning wall between two offices and to provide access from both offices or between an office and a common hallway to a printer or the like disposed within the enclosure; a slidable shelf adapted to support a printer or the like mounted between the side walls for slidable movement between the openings to provide working access to the printer or the like from either of the openings; and, a sound-deadening material disposed on the side walls and top member within the chamber.

In the preferred embodiment, the top member includes cooling means for drawing cooling air to the enclosure and exhausting it along a noise-suppressing path.

DESCRIPTION OF THE DRAWINGS

FIG. 1 is a side elevation view of a prior art approach to supporting and sound-proofing a computer printer or the like.

DESCRIPTION OF THE PREFERRED EMBODIMENT

Figure 1:
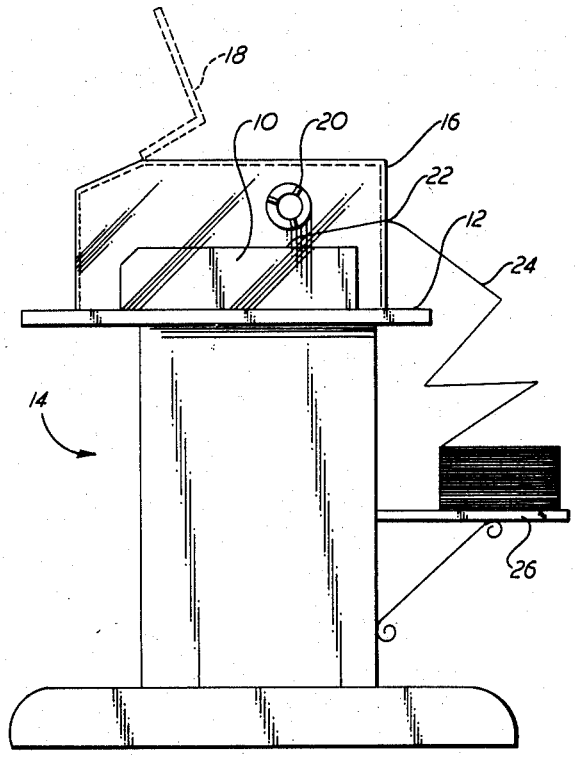
FIG. 1 Prior Art
Figure 2:
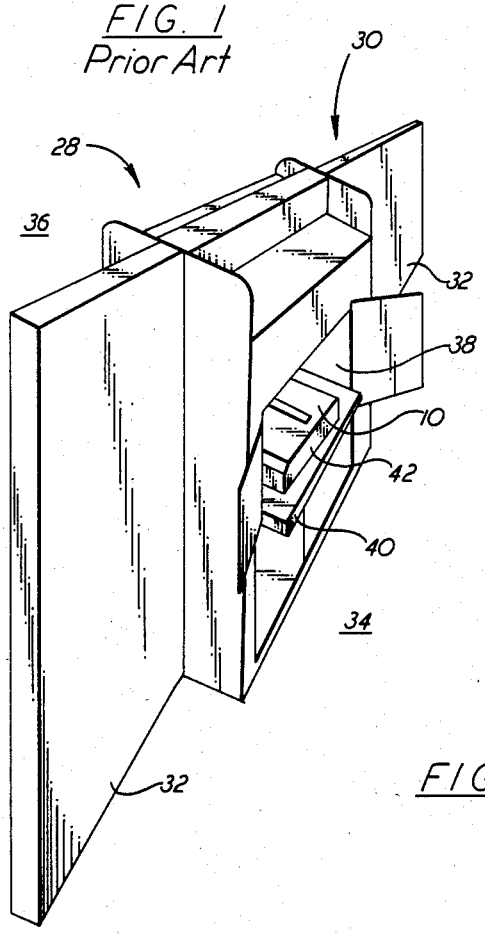
FIG. 2 is a diagrammatic perspective view of the present invention incorporated into a modular wall system.

Referring first to FIG. 2, a computer printer housing according to the present invention is generally indicated as 28 and shown in perspective as being incorporated into a modular wall 30 containing modular wall panels 32. The modular wall 30 and housing 28 act as a divider between two offices generally indicated as 34 and 36, respectively. A first opening 38 into the housing 28 is located in the first office 34. A second opening (not shown) is located within the second office 36. A slidable shelf 40 is located within the housing 28 and contains the printer 10 thereon. The sides 42 of the printer 10 face the first and second openings so that equal access is provided to the printer 10 from either of the offices 34, 36.

Turning now to FIGS. 3–8, the printer housing 28 of the present invention in its preferred embodiment will be described in greater detail. Housing 28 comprises a pair of opposed vertical side walls 44 connected across their tops by a top member 46 and their bottoms by a bottom member 48 to form a box defining an enclosure 50 having the first opening 38 and a second opening 52 communicating therewith on opposite sides. In the preferred embodiment, the enclosure 50 is divided substantially in half vertically by the horizontal member 54 which is shown in greater detail in FIG. 7. Each of the openings 38, 52 is openably closed by doors. In particular, the upper portion above the horizontal member 54 is closed by doors 56 which are of glass or clear plastic so as to provide viewing of the operation of the printer 10 from either of the offices 34, 36. Of course, the doors may be solid to provide greater noise reduction ability. The portion below the horizontal member 54 is provided with solid doors 58. In the preferred embodiment, doors 56 and 58 are door pairs hinged at 60 to open outwardly. As those skilled in the art will recognize, other door arrangements could be provided.

Within the upper portion of the enclosure 50, a shelf 62 is mounted to the side walls 44 on tracks 64 for slidable movement between the openings 38 and 52. The lower portion of the enclosure 50 below the horizontal member 54 is divided by a solid shelf 66. As thus configured, a storage space 68 is provided between the top of the bottom member 48 and the shelf 66.

Figure 3:
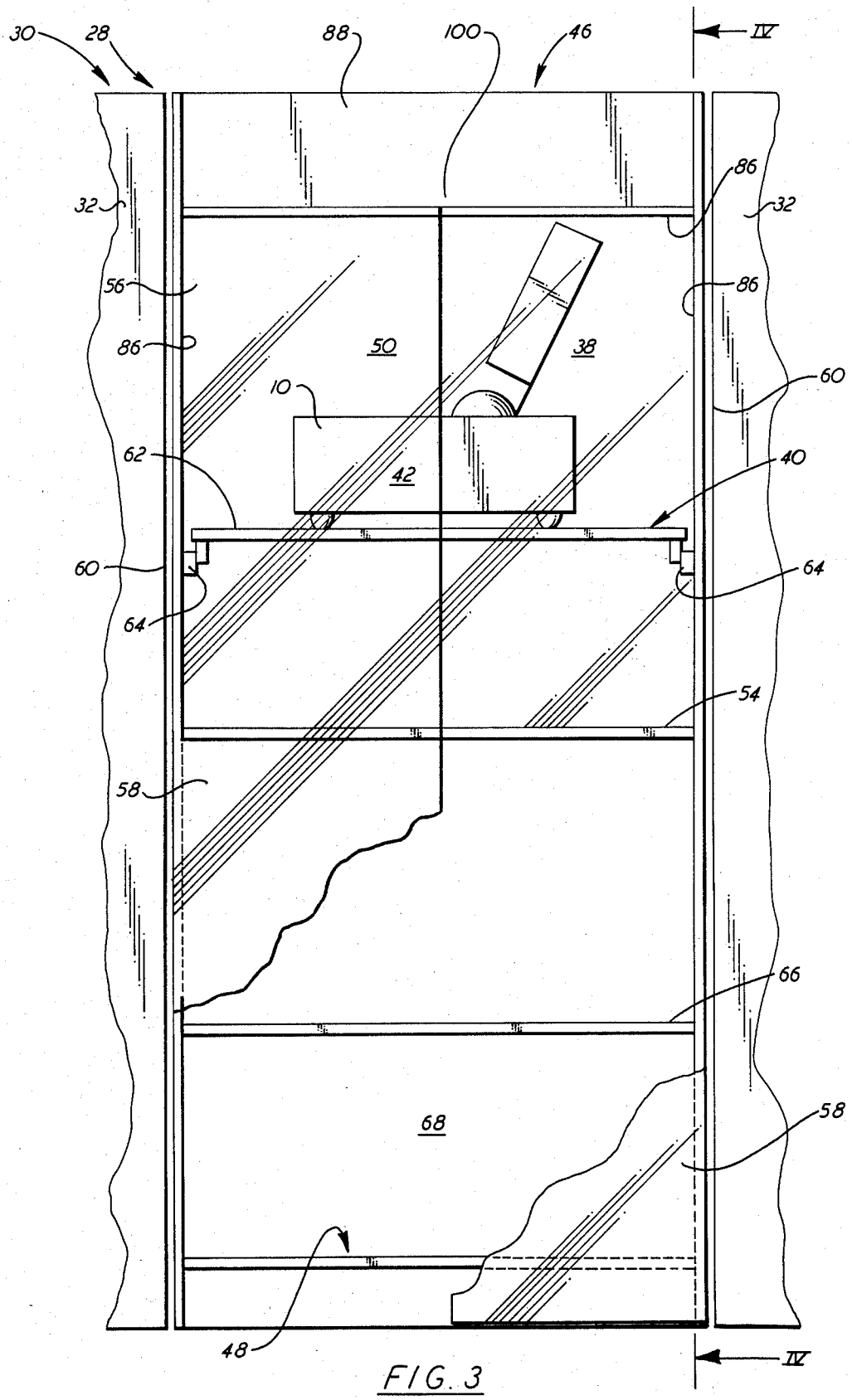
FIG. 3 is a side elevation view of a printer housing according to a preferred embodiment of the present invention.
Figure 4A:
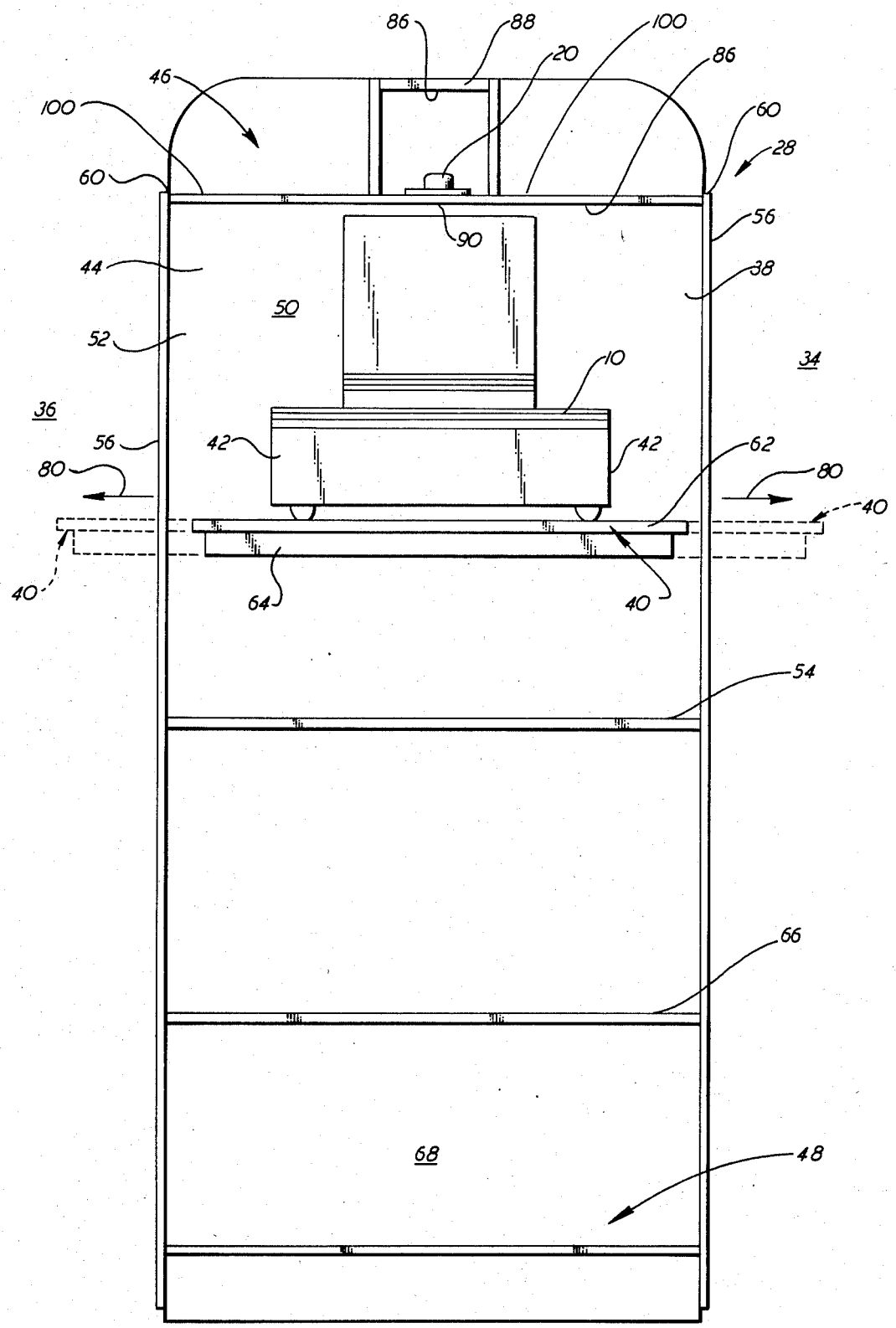
FIG. 4A is a front elevation view of the housing of FIG. 3.

To provide ready printer access from both offices 34,36 a printer (e.g. daisy wheel printer) 10 is placed sideways on shelf 62 as seen in FIGS. 3 and 4A. This printer 10 has a sheet feeder attached thereto.

It will be appreciated that the enclosure can readily be adapted to house and support two printers one above the other on fixed or moveable shelves.

Figure 8:
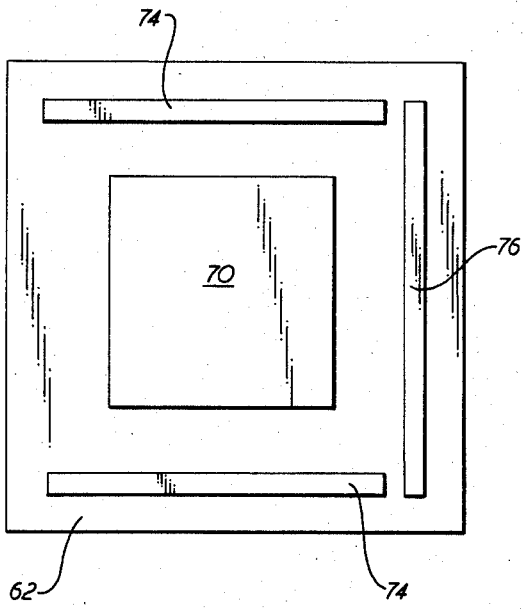
FIG. 8 shows the preferred structure for the slidable shelf of the present invention.

To provide the most versatile operation, the shelf 62 is configured as shown in FIG. 8. The printer 11 (see FIG. 4B) is disposed over a central opening 70 through which paper 24 from supply box 72 can pass into the printer 11 from the bottom in the usual manner. A pair of slots 74 are provided through the shelves 62 parallel to and adjacent to respective ones of the openings 38, 52. The slots 74 are used for paper 24 exiting the printer 11 when the printer 11 is placed in facing relationship to one of the offices 34, 36. As will be realized, when so placed, the printer 11 can only be used from one office with any convenience. A third slot 76 is placed normal to the slots 74 along one edge of the shelf 62. Slot 76 is an elongated slot such that when paper 24 is placed therethrough to pile at 78 on the shelf 66, as best seen in FIG. 3, the paper 24 will skew along the slot 76 when the shelf 62 is moved towards one of the offices 34, 36 for access to the printer 11 as indicated by the arrows 80 in FIG. 4B.

Figure 5:
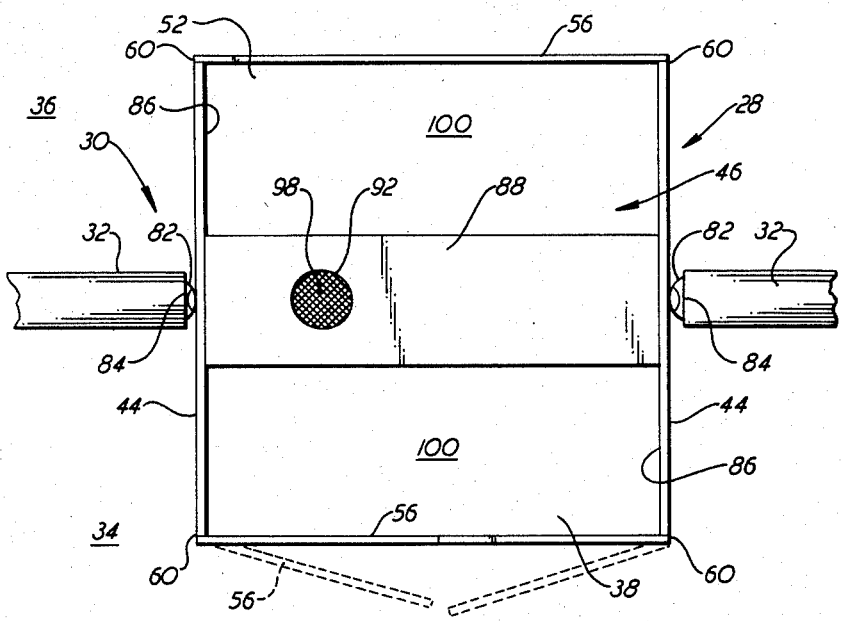
FIG. 5 is a top view of the housing of FIGS. 3 and 4.

As best seen in the top view of FIG. 5, the outer surface of each of the vertical side walls 44 is provided with an interlocking member 82 adapted to releasably mate with a matching member 84 on the ends of the modular wall panels 32 so that the housing 28 can be firmly established into the wall 30. To provide for sound-proofing, a suitable sound-proofing material 86, such as foam plastic, is used to line the inside surfaces of the side walls 44 and top member 46.

Figure 4B:
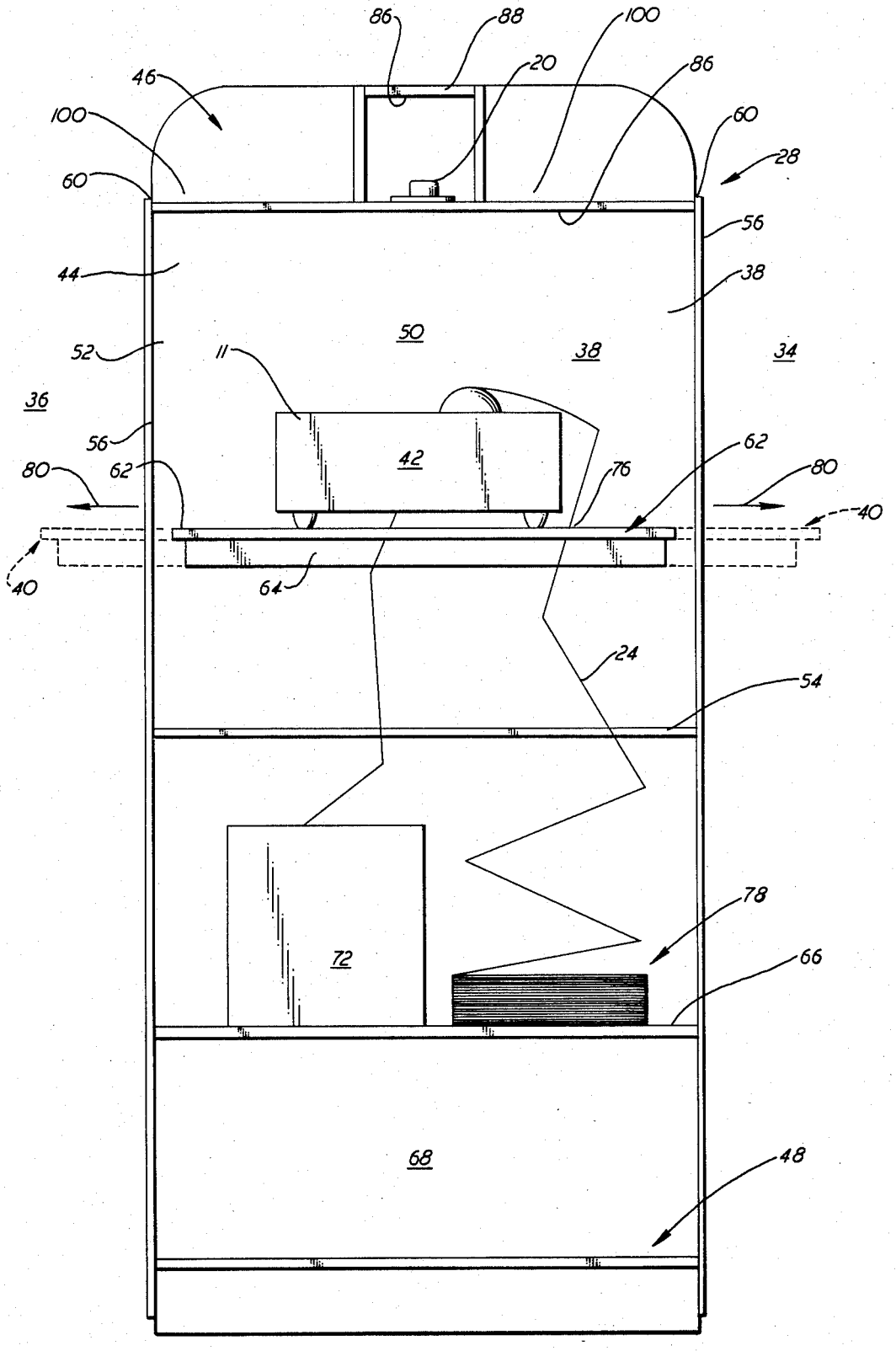
FIG. 4B is a front elevation view of the housing of FIG. 3 with provision for feeding and self-stacking continuous computer printer paper.
Figure 6:
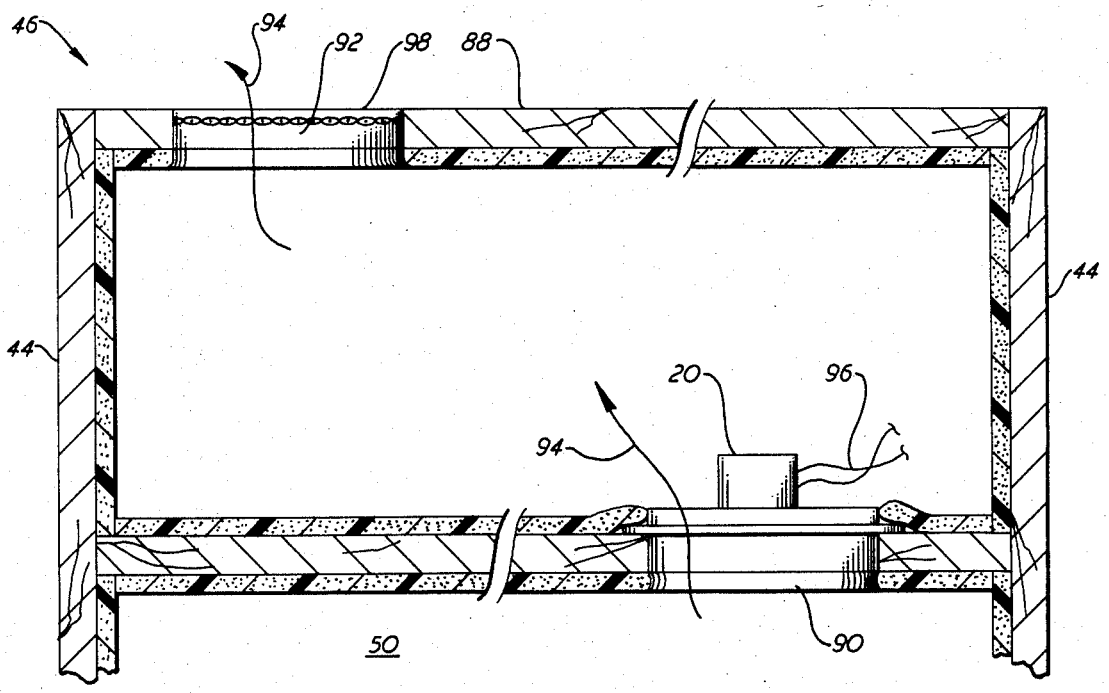
FIG. 6 is an enlarged detailed view of the top portion of the housing of FIGS. 3–5 showing the manner in which the cooling air is drawn therethrough along a sound-deadening path.
Figure 7:
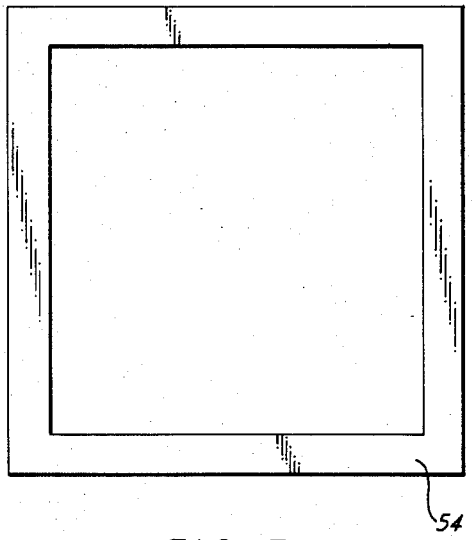
FIG. 7 shows the preferred structure for the central horizontal structural member of the housing of the present invention.

Turning now with particularity to FIG. 6, the manner of moving cooling air through the housing 28 in a noise-dampening manner will now be discussed in greater detail. The top member 46, as is the majority of the housing 28 of the present invention, is built of a wood-based material and has a box 88 formed therein. Box 88 includes first and second openings 90, 92, respectively, therein. First opening 90 is in communication with the enclosure 50 while second opening 92 is in communication with the ambient atmosphere. The openings 90, 92 are offset from one another and a muffin fan 20 is axially disposed within the first opening 90 so as to draw air 94 into box 88 and out of second opening 92 when the wires 96 are connected to a suitable source of electrical power. Opening 92 is closed by a wire scanning 98 and the inside of box 88 is lined with the sound-proofing material 86. As thus configured, with the muffin fan 20 in operation, air is drawn into enclosure 50, through the printer 10, and exhausted through the box 88. Because of the sound-proofing material 86 and the offset relationship of the openings 90, 92, most of the noise generated by the printer 10 and the muffin 20 is dissipated. As best seen in FIGS. 4A, 4B and 5, the box 88 is disposed longitudinally between the side walls 44 along the center of the top member 46 thus forming two useful shelf areas in the top member 46 at 100.

In the preferred embodiment of the present invention, the tracks 64 and the shelf 66 are vertically adjustably attached to the side walls 44 to provide for the use of printers 10 or 11, and the like, of different sizes. Moreover, it was found that by disposing the top of the printer 11 in relationship to the shelf 62 at least the distance of two segments of the paper 24, optimum refolding of the paper 24 on the takeup pile 78 can be achieved as paper 24 is fed out of the printer 11 during operation.

Wherefore, it can be seen that the above-described computer printer housing of the present invention has successfully met its stated objectives by providing a sound-proof enclosure designed to be incorporated within a modular wall unit providing ease of access to a printer, or the like, contained therein from either or both of adjoining offices separated by the modular wall.

Wherefore, having thus described my invention, I claim:

1. A free-standing unitary structure of a height adequate to serve as a wall member and constituting a sound-proofing housing for use with computer output printer comprising:

(a) a pair of vertical spaced side walls;

(b) a top member interconnecting the tops of said side walls;

(c) a bottom member interconnecting the bottoms of said side walls to form an enclosure having opposed openings thereto on opposite sides thereof;

(d) first door means disposed for openably closing one of said openings;

(e) second door means disposed for openably closing the other of said openings;

(f) a slidable shelf separate from said two door means adapted to support a printer mounted between said side walls for slidable movement between said openings to provide working access to the printer from either of said openings;

(g) a sound-deadening material disposed on said side walls and top member within said chamber and (h) a lower storage space for holding a paper supply for said computer printer and receiving printer paper from said computer, openings in said shelf for permitting passage of said paper to and from the computer printer.

2. The housing of claim 1 wherein:

said side walls include means for releasably attaching a modular wall partition thereto whereby the housing can be built into a partitioning wall between two offices and provide access from both offices to a printer or the like disposed within said enclosure.

3. The housing of claim 1 wherein:

said top member includes cooling means for drawing cooling air through said enclosure and exhausting it along a noise-suppressing path.

4. The housing of claim 3 wherein said cooling means comprises:

(a) a box incorporated into said top member and having first and second openings therein offset from one another, said first opening being in communication with said enclosure, said second opening being in communication with the ambient atmosphere; and, (b) fan means for moving air through said box between said first and second openings.

5. The housing of claim 4 wherein:

(a) said box is lined with a sound-deadening material; and, (b) said fan is axially disposed in said first opening.

6. The housing of claim 1 wherein:

said slidable shelf has a first slot for the passage of paper therethrough adjacent and parallel to one of said openings, a second slot for the passage of paper therethrough adjacent and parallel to the other of said openings, and a third slot for the passage of paper therethrough adjacent and parallel to one of said side walls whereby a printer or the like can be operably disposed facing either of said openings or crosswise to said openings to serve both.

7. A free-standing unitary structure of a height adequate to serve as a wall member and constituting a sound-proofing housing for a computer output printer and which can be disposed in a wall between adjacent offices and comprising:

(a) a box having a pair of vertical spaced side walls, a top member interconnecting the tops of said side walls and a bottom member interconnecting the bottoms of said side walls to form an enclosure having opposed openings thereto on opposite sides thereof;

(b) first and second door means disposed for openably closing respective ones of said openings;

(c) means included in said side walls for releasably attaching a modular wall partition thereto whereby the housing can be built into a partitioning wall between two offices and provide access from both offices to a printer or the like disposed within said enclosure;

(d) a slidable shelf separate from said first and second door means adapted to support a printer mounted between said side walls for slidable movement between said openings to provide working access to the printer from either of said openings;

(e) a sound-deadening material disposed on said side walls and top member within said chamber;

(f) a lower storage space for holding a paper supply for said computer printer and receiving printed paper from said computer, openings in said shelf for permitting passage of said paper to and from the computer printer; and (g) means for adjusting the distances between the shelf and the paper storage space to permit optimum refolding of printed paper.

8. The housing of claim 7 wherein:

said top member includes cooling means for drawing cooling air through said enclosure and exhausting it along a noise-suppressing path.

9. The housing of claim 8 wherein said cooling means comprises:

(a) a box incorporated into said top member and having first and second openings therein offset from one another, said first opening being in communication with said enclosure, said second opening being in communication with the ambient atmosphere; and, (b) fan means for moving air through said box between said first and second openings.

10. The housing of claim 9 wherein:

(a) said box is lined with a sound-deadening material; and, (b) said fan is axially disposed in said first opening.

11. The housing of claim 7 wherein:

said slidable shelf has a first slot for the passage of paper therethrough adjacent and parallel to one of said openings, a second slot for the passage of paper therethrough adjacent and parallel to the other of said openings, and a third slot for the passage of paper therethrough adjacent and parallel to one of said side walls whereby a printer or the like can be operably disposed facing either of said openings or crosswise to said openings to serve both.

* * * * *